US010983547B1

(12) United States Patent
Ivanov

(10) Patent No.: US 10,983,547 B1
(45) Date of Patent: Apr. 20, 2021

(54) BANDGAP REFERENCE CIRCUIT WITH REDUCED FLICKER NOISE

(71) Applicant: Panasonic Intellectual Property Management Co., Ltd., Osaka (JP)

(72) Inventor: Evgueni Ivanov, Lexington, MA (US)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/775,470

(22) Filed: Jan. 29, 2020

(51) Int. Cl.
*G05F 3/30* (2006.01)
*G05F 3/26* (2006.01)

(52) U.S. Cl.
CPC ..... *G05F 3/267* (2013.01); *G05F 3/30* (2013.01)

(58) Field of Classification Search
CPC . G05F 3/30; G05F 3/205; G05F 3/242; G05F 3/245; G05F 3/247; G05F 3/262; G05F 3/265; G05F 3/267
See application file for complete search history.

(56) References Cited

U.S. PATENT DOCUMENTS 10,386,243 B2 8/2019 Abughazaleh et al.
2008/0157746 A1* 7/2008 Chen ..... G05F 3/30 323/313
2016/0135749 A1* 5/2016 Chan ..... A61B 5/6852 600/301

OTHER PUBLICATIONS

Van Veldhoven and Dijkmans, "A bandgap reference using chopping for reduction of 1/f noise and random offset", Philips research laboratories, Eindhoven, Netherlands, 1999.

* cited by examiner

*Primary Examiner* — Long Nguyen
(74) *Attorney, Agent, or Firm* — Pearne & Gordon LLP

(57) ABSTRACT

The present disclosure provides bandgap reference circuits having multi-level chopping actions to current mirror circuits for the purpose of reducing the flicker noise of the output reference voltage. A bandgap reference circuit includes a first current mirror including a pair of a first MOSFET and a second MOSFET, a second current mirror comprising a third MOSFET electrically connected to the first current mirror, and configured to provide a reference voltage at a drain, a first bipolar junction transistor electrically connected to the first current mirror, a second bipolar junction transistor connected to the first current mirror via a first resistor, a third bipolar junction transistor connected to the third MOSFET via a second resistor. The bandgap reference circuit further includes an operational amplifier to control the MOSFETs and a plurality of chopping switches configured to perform chopping actions on outputs of the first current mirror and the second current mirror.

20 Claims, 9 Drawing Sheets

BANDGAP REFERENCE CIRCUIT WITH REDUCED FLICKER NOISE

TECHNICAL FIELD

The present disclosure relates to bandgap reference circuits with reduced flicker noise. More particularly, the present disclosure relates to bandgap reference circuits having multi-level chopping actions to current mirror circuits.

BACKGROUND

Bandgap reference circuits are electrical circuits commonly used for generating accurate reference voltages and currents. Bandgap reference circuits achieve stable reference voltage over temperature by combining the $V_{be}$ and $\Delta V_{be}$ with certain coefficients to cancel their temperature drifts, where $V_{be}$ is a base-emitter voltage of a forward-biased bipolar junction transistor or anode-cathode voltage of a forward-biased diode, and $\Delta V_{be}$ is a difference between base-emitter voltages of unequally sized forward-biased bipolar junction transistors or between anode-cathode voltages of unequally sized forward-biased bipolar diodes.

SUMMARY

The present disclosure provides apparatus for significantly reducing the flicker noise in the current-mode bandgap reference circuits by applying chopping actions to the current mirrors.

In one embodiment, a bandgap reference circuit includes a first current mirror including a pair of a first metal-oxide-semiconductor field-effect transistor (MOSFET) and a second MOSFET, a second current mirror comprising a third MOSFET electrically connected to the first current mirror and configured to provide a reference voltage at a drain of the third MOSFET, a first bipolar junction transistor electrically connected to the first current mirror, a second bipolar junction transistor electrically connected to the first current mirror via a first resistor, a third bipolar junction transistor electrically connected to the third MOSFET via a second resistor; and a plurality of chopping switches configured to perform chopping actions on outputs of the first current mirror and the second current mirror.

In another embodiment, a bandgap reference circuit includes a first current mirror including a pair of a first MOSFET and a second MOSFET, a second current mirror including a third MOSFET and a fourth MOSFET, the third MOSFET electrically connected to the first current mirror device and configured to provide a reference voltage, and the fourth MOSFET electrically connected to the first current mirror and to a first resistor, a first bipolar junction transistor electrically connected to the first current mirror; a second bipolar junction transistor electrically connected to the first current mirror via a first resistor, a third bipolar junction transistor electrically connected to the third MOSFET via a second resistor, and an operational amplifier with first and second inputs and an output, wherein each of the first and second inputs is connected to emitters of the first bipolar junction transistor and the second bipolar junction transistor, respectively, and the output is connected to gates of the first MOSFET, the second MOSFET, and the third MOSFET, respectively, wherein the first and second inputs to the operational amplifier are chopped with a first frequency.

In yet another embodiment, a bandgap reference circuit includes a first current mirror device including a pair of a first metal-oxide-semiconductor field-effect transistor (MOSFET) and a second MOSFET, a second current mirror including a third MOSFET and a fourth MOSFET, the third MOSFET electrically connected to the first current mirror device and configured to provide a reference voltage, and the fourth MOSFET electrically connected to the first current mirror and to a first resistor, a first bipolar junction transistor electrically connected to the first current mirroring device, a second bipolar junction transistor electrically connected to the first current mirroring device via a second resistor, a third bipolar junction transistor electrically connected to the third MOSFET via a third resistor, a first switch configured to alternatively switch between the first MOSFET and the third MOSFET, a second switch configured to alternatively switch between the second MOSFET and the fourth MOSFET, a third switch configured to alternatively switch between the first MOSFET and the third MOSFET, and a fourth switch configured to alternatively switch between the second MOSFET and the fourth MOSFET, a fifth switch configured to alternatively electrically connect the first switch or the second switch to the first bipolar junction transistor, and a sixth switch configured to alternatively electrically connect the first switch or the second switch to the first resistor, wherein when the first switch connects the first MOSFET the third switch connects the third MOSFET, and when the first switch connects the third MOSFET the third switch connects the first MOSFET, wherein when the second switch connects the second MOSFET the fourth switch connects the fourth MOSFET, and when the second switch connects the fourth MOSFET the fourth switch connects the second MOSFET, wherein when the fifth switch connects the first switch the sixth switch connects the second switch, and when the fifth switch connects the second switch the sixth switch connects the first MOSFET.

Other aspects, advantages, and salient features of the disclosure will become apparent to those skilled in the art from the following detailed description, which, taken in conjunction with the annexed drawings, discloses exemplary embodiments of the disclosure.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

Throughout the drawings, it should be noted that like reference numbers are used to depict the same or similar elements, features, and structures.

DETAILED DESCRIPTION

FIGS. 1 through 9, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system and method. The following description with reference to the accompanying drawings is provided to assist in a comprehensive understanding of various embodiments of the present disclosure as defined by the claims and their equivalents. It includes various specific details to assist in that understanding but these are to be regarded as merely examples. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

It should be apparent to those skilled in the art that the following description of various embodiments of the present disclosure is provided for illustration purpose only and not for the purpose of limiting the present disclosure as defined by the appended claims and their equivalents.

Although ordinal numbers such as "first," "second," and so forth will be used to describe various components, those components are not limited herein. The terms are used only for distinguishing one component from another component. For example, a first component may be referred to as a second component and likewise, a second component may also be referred to as a first component, without departing from the teaching of the inventive concept.

The terminology used herein is for the purpose of describing various embodiments only and is not intended to be limiting. As used herein, the singular forms are intended to include the plural forms as well, unless the context clearly indicates otherwise. It will be further understood that the terms "comprises" and/or "has," when used in this specification, specify the presence of a stated feature, number, step, operation, component, element, or combination thereof, but do not preclude the presence or addition of one or more other features, numbers, steps, operations, components, elements, or combinations thereof.

Bandgap reference circuits can be divided into two types: voltage-mode bandgap reference circuits and current-mode bandgap reference circuits.

Figure 1:
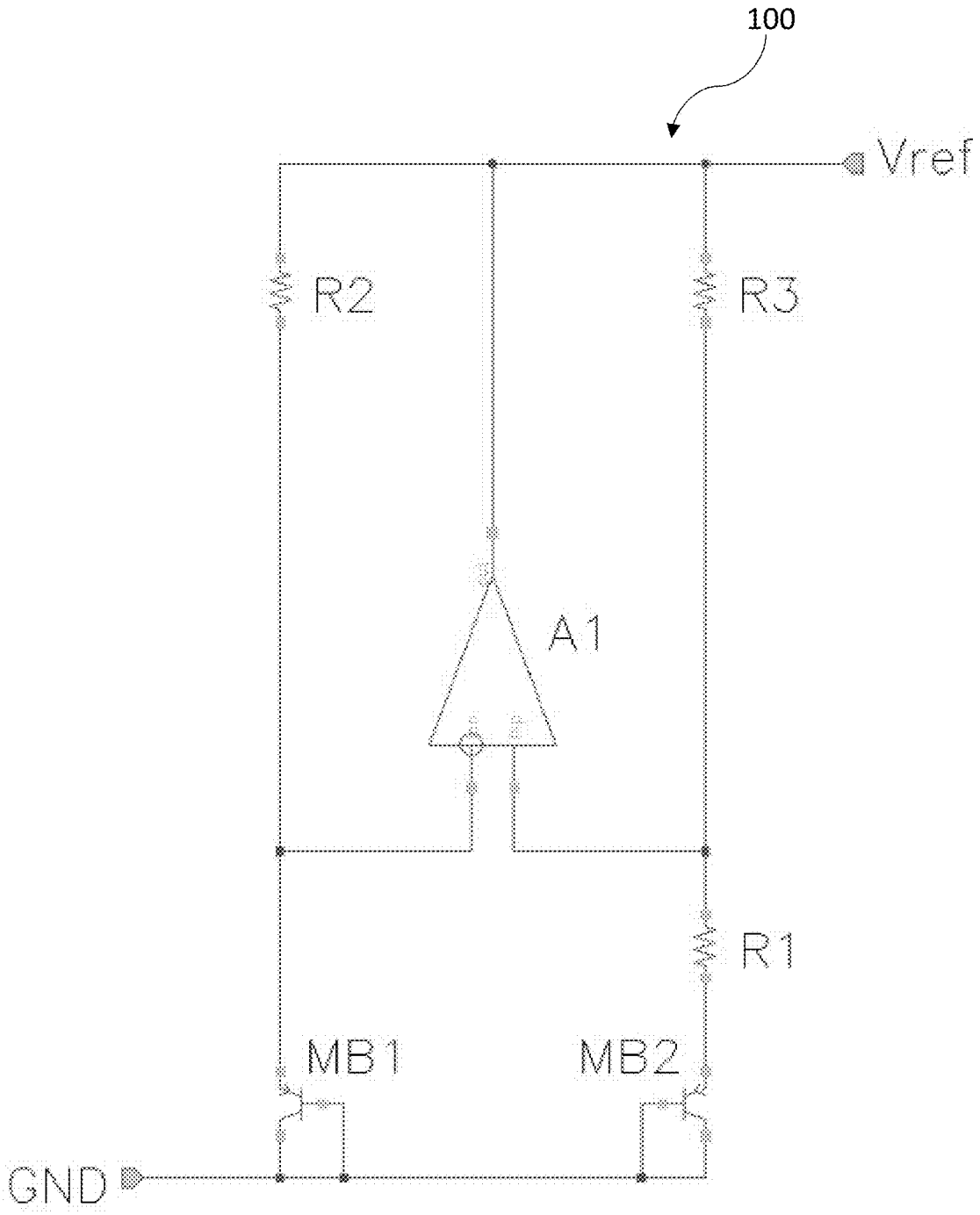
FIG. 1 illustrates an example of a voltage-mode bandgap reference circuit.

FIG. 1 illustrates an example of a voltage-mode bandgap reference circuit 100. The bandgap reference circuit 100 includes operational amplifier A1 with first and second inputs and an output. The first and second inputs of operational amplifier A1 are coupled to a pair of transistors MB1, MB2, respectively. The operational amplifier A1 provides a voltage reference at its output.

The pair of transistors can include a first bipolar junction transistor MB1 and second bipolar junction transistor MB2. The first and second transistors MB1, MB2 are provided in a diode configuration with its base and collector commonly coupled. The bases of the first and second transistors MB1, MB2 are coupled and are grounded.

The first transistor MB1 is coupled to amplifier input A1 at its emitter node and is coupled to amplifier output A1 via resistor R2. Second transistor MB2 is coupled to amplifier input A1 at its emitter node via resistor R1 and is coupled to the output of amplifier A1 via resistor R3. The commonly coupled collectors of first and second transistors MB1 and MB2 are coupled and are grounded.

In the bandgap reference circuit 100, operational amplifier A1 controls the voltage applied to the bandgap core circuit including the resistors R1, R2, R3 and the first and second bipolar junction transistors MB1, MB2.

Figure 2:
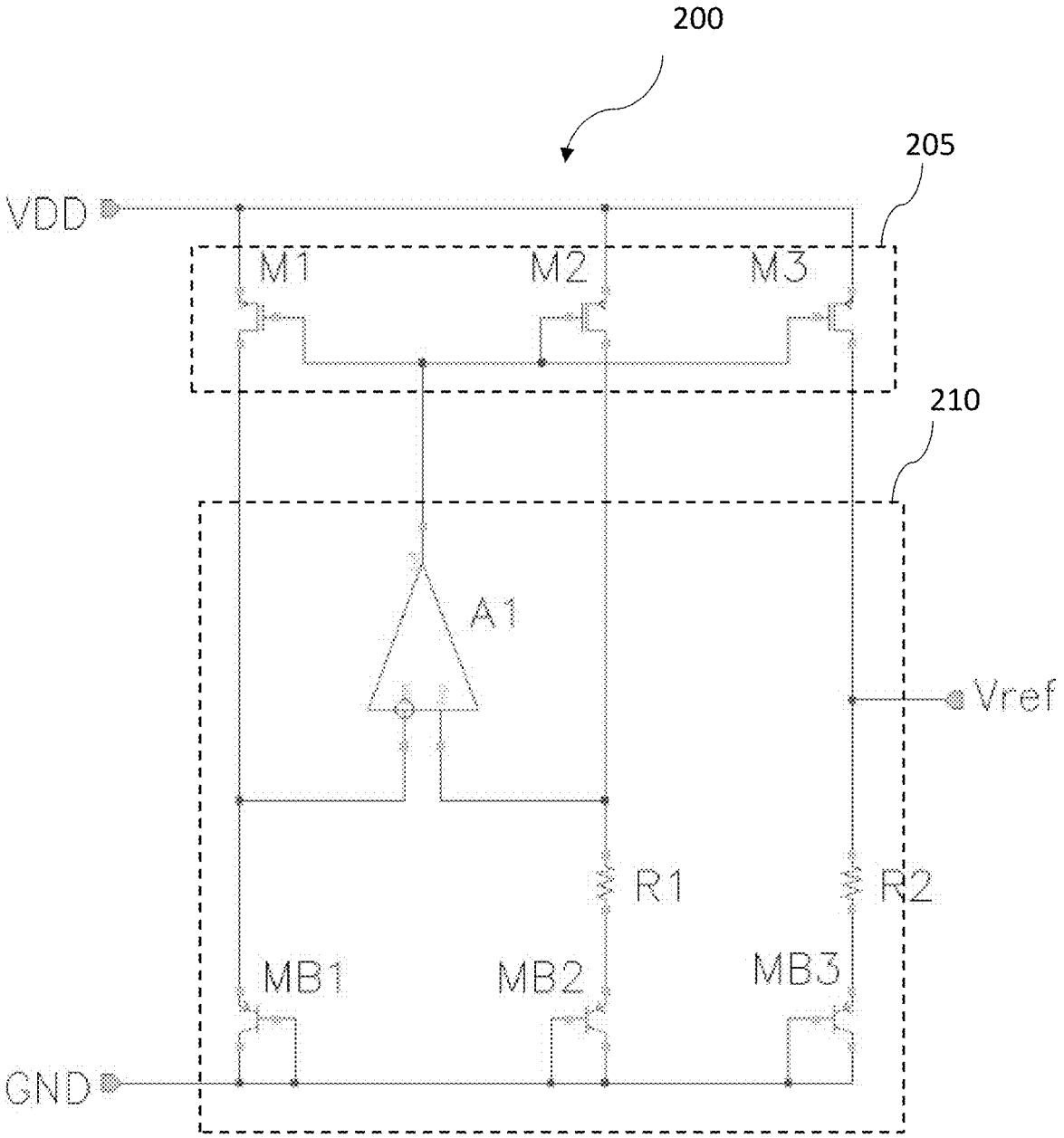
FIG. 2 illustrates an example of a current-mode bandgap reference circuit.

FIG. 2 illustrates an example of a current-mode bandgap reference circuit 200. The bandgap reference circuit 200 includes current mirror circuit 205 and bandgap core circuit 210.

The current mirror circuit 205 includes a pair of metal oxide semiconductor field effect transistors (MOSFETs) M1 and M2, and another MOSFET M3. Each of three transistors M1, M2 and M3 is connected to the supply voltage VDD via their respective source nodes. Each of three transistors M1, M2 and M3 outputs the mirror current at their respective drain nodes. Transistor M3 provides a voltage reference at its drain node.

Bandgap core circuit 210 includes operation amp A1, bipolar junction transistors MB1 to MB3, and resistors R1 and R2. The first and second inputs of operational amp A1 are coupled to a pair of bipolar junction transistors MB1 and MB2. The output of operational amp A1 is provided to the gates of each of a pair of two transistors M1 and M2 and to the gate of transistor M3.

Transistor MB1 is coupled to the drain node of the transistor M1 at its emitter node, and the transistor MB2 is coupled to the drain node of the transistor M2 at its emitter node via resistor R1. Transistor MB3 is coupled to the drain node of the transistor M3 at its emitter node via resistor R2.

The three bipolar junction transistors MB1, MB2 and MB3 are provided in a diode configuration with their base and collector commonly coupled. Also, the bases of the three bipolar junction transistors MB1, MB2 and MB3 are coupled together. The commonly coupled collectors of the three transistors MB1, MB2 and MB3 are coupled to ground.

In the current-mode bandgap reference circuit 200, operational amplifier A1 controls the current applied to the bandgap core circuit 210 including the resistor R1 and transistors MB1, MB2 by controlling the gates of the current source transistors M1, M2.

The current that is passed through the transistor M3 is proportional to the absolute temperature (PTAT). The reference voltage Vref is formed in a separate current branch in which the PTAT current passes through resistor R2 and bipolar junction transistor MB3, which has a temperature coefficient opposite to one of the PTAT current.

When bandgap reference circuits are used in low noise circuits it is often required that the noise of their output reference voltage would be also low, including the low levels of the flicker (1/f) noise.

One possible technique to reduce the flicker noise is chopping. The chopping technique refers to periodically swapping two identical and symmetrically arranged groups of selected components between positive and negative signal paths in a circuit so that their contribution to the signal error and noise periodically changes sign and therefore, after time averaging, becomes canceled. The chopping technique can be implemented by chopping switches operating with a certain frequency, as described in the present disclosure.

Figure 3:
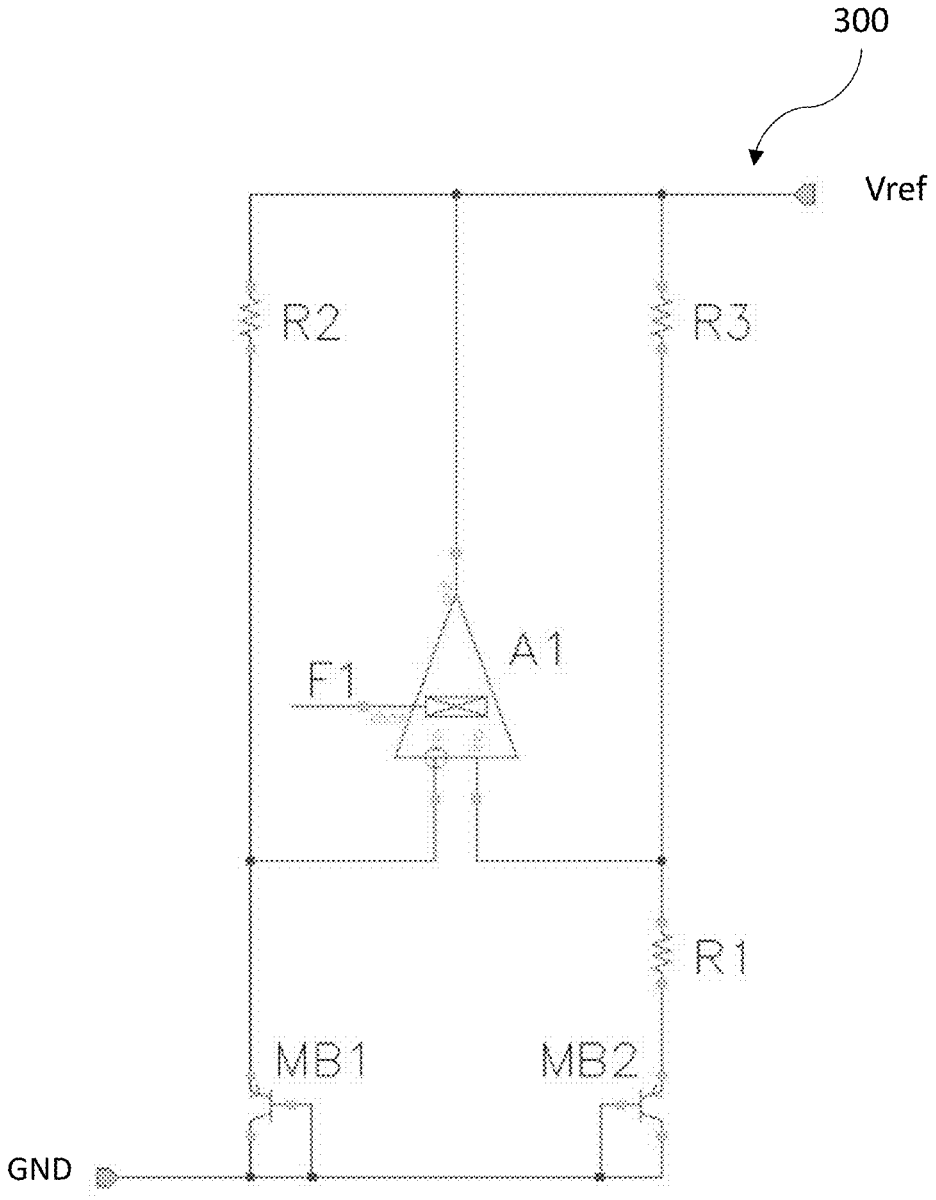
FIG. 3 illustrates another example of a voltage-mode bandgap reference circuit.

FIG. 3 illustrates another example of a voltage-mode bandgap reference circuit 300. The voltage-mode bandgap reference circuit 300 illustrated in FIG. 3 is similar to the circuit in FIG. 1 except that a chopping circuit is provided at the inputs to the operational amp. Thus, the repeated descriptions thereof are omitted.

In the bandgap reference circuit 300 of the FIG. 3, a chopping circuit is included in the operational amplifier A1 and the input signals to the operational amplifier A1 are being chopped with a first configured frequency. As a result, the cancellation of the flicker noise in the voltage-mode bandgap reference circuit can be achieved.

In the current-mode bandgap reference circuits, applying chopping to the operational amplifier may not be sufficient to reduce the flicker noise because a significant portion of the current-mode bandgaps flicker noise is caused by the current mirror circuits.

There are several methods to lower the flicker noise in the current-mode bandgap reference circuit by applying the dynamic element matching (DEM) technique to the three current sources transistors M1, M2, M3 by means or periodically rotating their connections to the circuit current branches (e.g., M1, M2, M3→M3, M1, M2→M2, M3, M1).

However, the DEM technique only performs averaging of the flicker noise of the switched components but does not fully cancel the noise. Therefore, the DEM averaging of the noise from the three components M1, M2, M3 indeed reduced the flicker noise at the output, however, the reduction is only by a factor of square root of 3.

Figure 4:
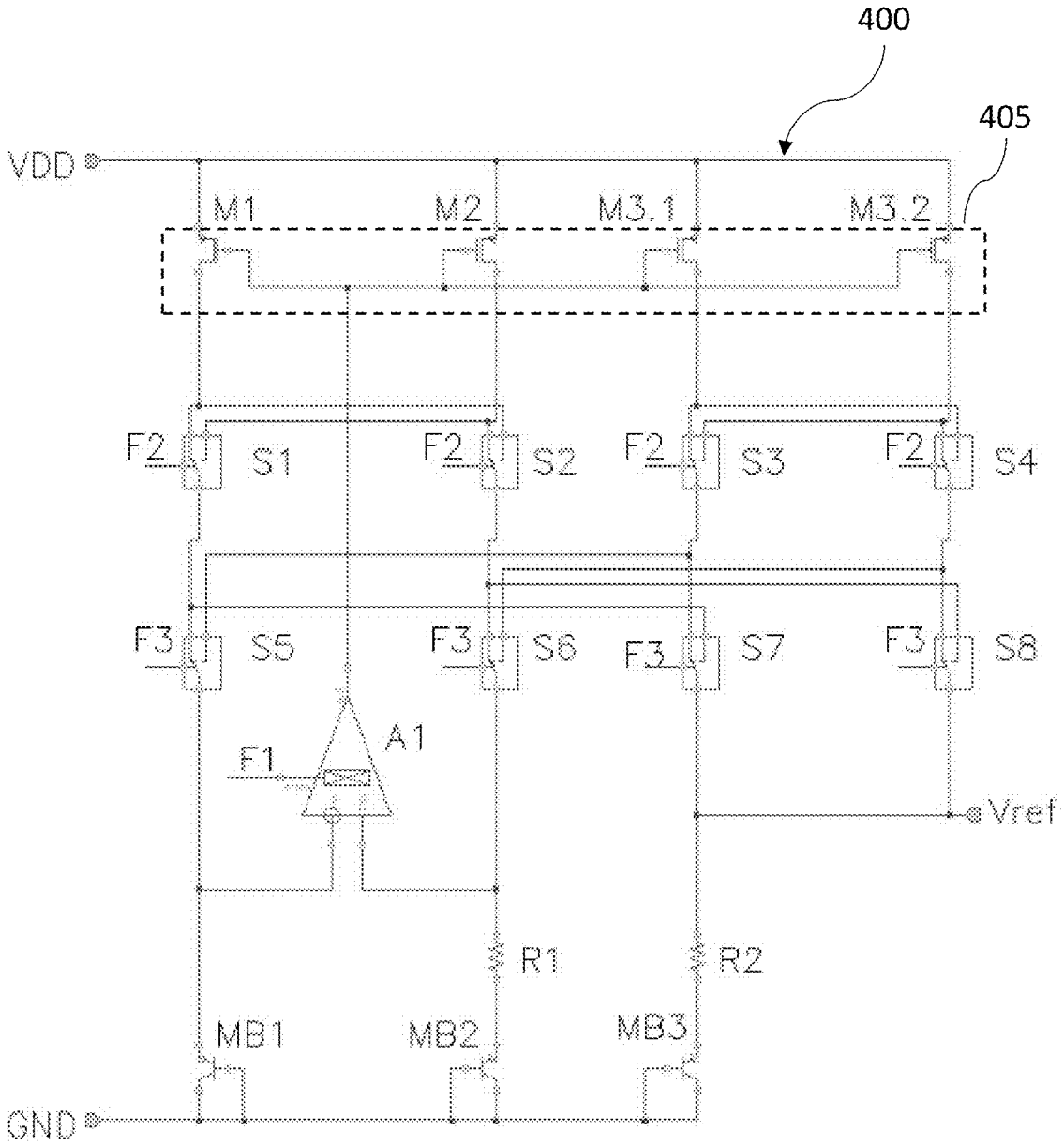
FIG. 4 illustrates another example of a current-mode bandgap reference circuit according to one embodiment of the present disclosure.

FIG. 4 illustrates another example of a current-mode bandgap reference circuit 400 according to one embodiment of the present disclosure. Bandgap reference circuit 400 illustrated in FIG. 4 is basically similar to bandgap reference circuit 200 in FIG. 2 other than that chopping switches are added to the circuit 400. The repeated descriptions thereof are omitted.

Bandgap reference circuit 400 includes current mirror circuit 405, an operational amplifier A1, and multi-level chopping circuits.

The current mirror circuit 405 includes the first pair of MOSFETs M1 and M2, and the second pair of MOSFETs M3.1 and M3.2. Each of four transistors M1, M2 and M3.1 and 3.2 is connected to the supply voltage VDD via their respective source nodes. Each of transistors M1, M2 and M3.1 and M3.2 outputs the mirror currents at their respective drain nodes. The mirror currents from the drain nodes of transistors M1, M2 and M3.1 and M3.2 may be the same. Also, transistor M3.2 provides a voltage reference at its drain node.

The output of operational amp A1 is provided to the gates of each of the first pair of transistors M1 and M2 and to the gates of the second pair of transistors M3.1 and M3.2. The first and second inputs of operational amp A1 are coupled to a pair of bipolar junction transistors MB1 and MB2.

In bandgap reference circuit 400, each of the branches of M1, M2, and M3 circuits contribute to the flicker noise in the output reference voltage of the bandgap. In order to cancel the flicker noise contribution of branches of M1, M2, and M3 circuits, a chopping needs to be applied to all three branches. The present disclosure provides the following chopping schemes that are applicable to all of the circuits or all groups of circuits at a time.

In order to make the schematic feasible to apply chopping, the transistors M1 and M2 need to be of equal sizes. In addition, the current mirror M3 in the output branch (that is generating the output reference voltage) comprises two equally sized transistors M3.1 and M3.2 which are also sized equal to the transistors in the current mirror transistors M1, M2.

The bandgap reference circuit 400 performs three-level chopping actions. The first level chopping is performed by a chopping circuit included in operation amplifier A1. The chopping circuit for operation amplifier A1 can include two switches for a non-inverting input signal and an inverting input signal and the input signals to the operational amplifier A1 are being chopped by the two switches with a first configured frequency.

The second level chopping is performed by four chopping switches S1 to S4: two chopping switches S, S2 switch between two drain nodes of MOSFETs M1 and M2, and another two chopping switches S3, S4 switch between two drain nodes of MOSFETs M3.1 and M3.2. Chopping switches S1 and S2 select different MOSFETs from each other, and chopping switches S3 and S4 select different MOSFETs from each other. In other words, when S1 switches to M1 S2 switches to M2, and when S1 switches to M2 S2 switches to M1. When S3 switches to M3.1 S4 switches to M3.2, and when S3 switches to M3.2 S4 switches to M3.1. Chopping switches S1 to S4 are operated at the same second frequency.

The action of this second level chopping is to periodically interconnect the MOSFETs M1 and M2 between the left (the line of MB1) and right (the line of MB2 and R1) branches of the bandgap core circuit. The second level of chopping cancels the flicker noise contributed from the MOSFETs M1 and M2.

The third level chopping can be performed by four chopping switches S5 to S8 by placing two additional pairs of interconnected switches S5-S8. In particular, the switch S5 alternatively switches between the outputs of switch S1 and switch S3, switch S6 alternatively switches between the outputs of switch S2 and switch S4, switch S7 alternatively switches between the outputs of switch S1 and switch S3, and switch S8 alternatively switches between the outputs of switch S2 and switch S4.

Chopping switch S5 and switch S7 select different MOSFETs from each other, and chopping switch S6 and switch S8 select different MOSFETs from each other. In other words, when S5 switches to S S7 switches to S3, and when S5 switches to S3 S7 switches to S1. When S6 switches to S2 S8 switches to S4, and when S8 switches to S4 S8 switches to S2.

The reference circuit 400 can apply a third chopping frequency F3 to the control inputs of the switches S5 to S8.

The third-level chopping is applied to the two pairs of the current mirror transistors, the first pair of MOSFETs M1-M2 and the second pair of MOSFETs M3.1-M3.2 pair, at the chopping frequency F3.

The action of this third level chopping is to periodically swap the pairs of transistors M1-M2 and M3.1-M3.2 between two branches (a branch of MB1 and a branch of MB2 and R1) of the bandgap core circuits and the output current branch MB3, R2 that generates the output reference voltage.

The third level chopping cancels the flicker noise contribution from the M3.1-M3.2 transistors. However, in order for the third level of chopping to work, an additional pair of switches S3-S4 should be connected to the drains of the M3.1-M3.2 transistors so that the M3.1-M3.2 transistors can be chopped when they are connected to the bandgap core circuit.

The third chopping frequency F3 should be at least two times smaller than the second chopping frequency F2 in order to ensure a completion of at least one full chopping cycle of M1, M2 transistors before the chopping between the pair of M1 and M2 and the pair of M3.1 and M3.2 occurs. Typically, the value of the second chopping frequency F2 can be equal to one of the second chopping frequency F3 multiplied by a factor of a power of 2: $F2=F3*2^N$.

In other embodiments of the present disclosure may include additional devices for further performance improvements.

Figure 5:
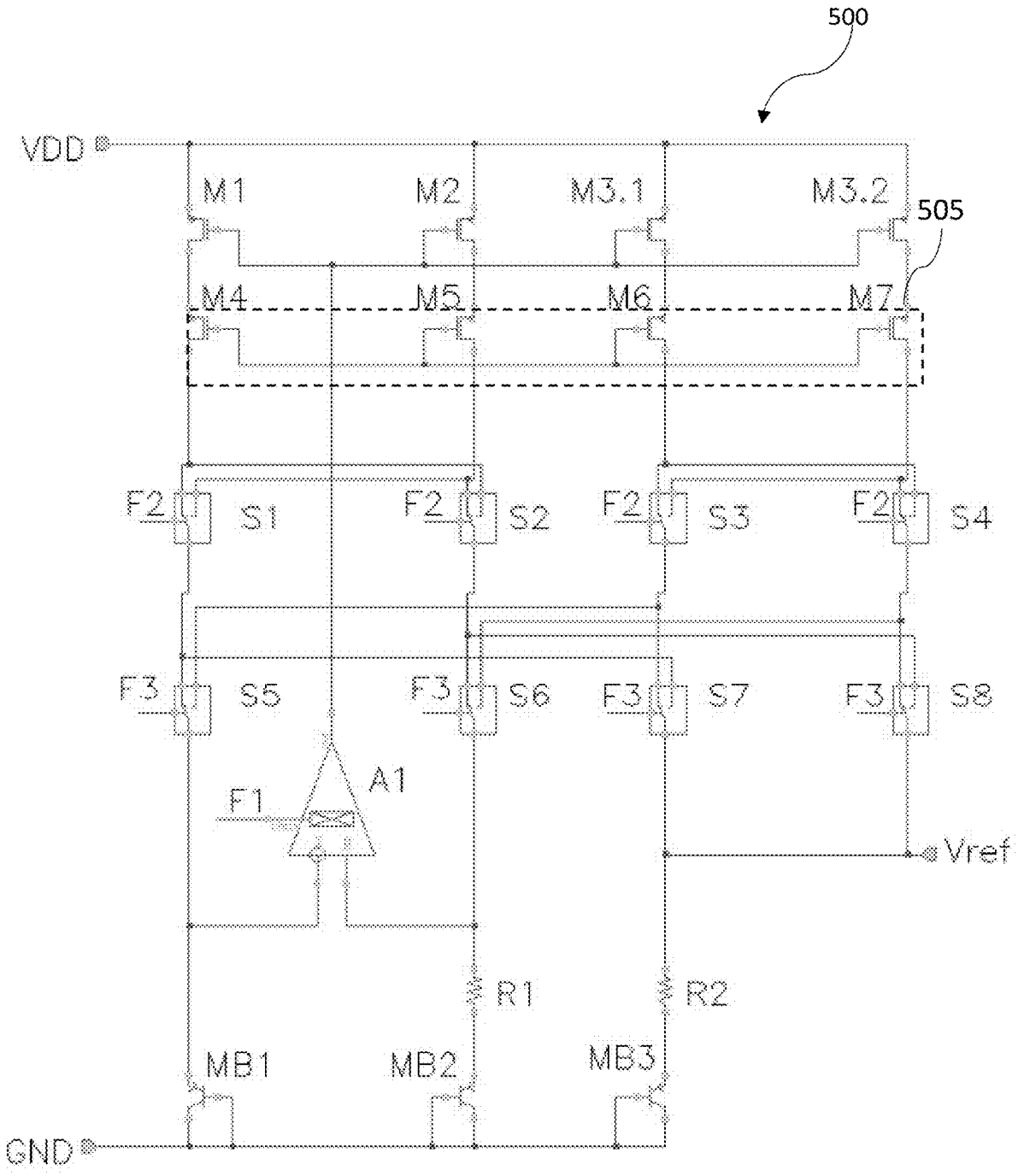
FIG. 5 illustrates another example of a current-mode bandgap reference circuit according to one embodiment of the present disclosure.

FIG. 5 illustrates another example of a current-mode bandgap reference circuit according to one embodiment of the present disclosure. The voltage-mode bandgap reference circuit 500 illustrated in FIG. 5 is similar to the current-mode bandgap reference circuit 400 in FIG. 4 other than that cascode circuits are added to the voltage-mode bandgap reference circuit 500. The repeated descriptions thereof are omitted.

In this embodiment, cascode circuits are added to the current mirror circuits in order to decrease the sensitivity of the output reference voltage and reference current to the supply voltage.

The cascode circuit can include MOSFETs M4, M5, M6, and M7. Transistor M4 is coupled to the drain node of the transistor M1 at its emitter node, transistor M5 is coupled to the drain node of the transistor M2 at its emitter node, transistor M6 is coupled to the drain node of the transistor M3.1 at its emitter node, and the transistor M7 is coupled to the drain node of the transistor M3.2 at its emitter node. In one embodiment, the output of operational amp A1 can be provided to the gates of each of a pair of four transistors M4, M5, M6, and M7.

Chopping switches S1-S8 can be coupled to the drains of the current sources. In this embodiment, each of chopping switches S1-S4 is coupled to the respective drains of transistors M4 to M7, respectively. In this embodiment, two chopping switches S1, S2 switch between two drain nodes of MOSFETs M1 and M2, and another two chopping switches S3, S4 switch between two drain nodes of MOSFETs M6 and M7. Chopping switches S1 and S2 select different MOSFETs from each other, and chopping switches S3 and S4 select different MOSFETs from each other. In other words, when S1 switches to M1 S2 switches to M2, and when S1 switches to M2 S2 switches to M1. When S3 switches to M6 S4 switches to M7, and when S3 switches to M7 S4 switches to M6. Chopping switches S1 to S4 are operated at the same second frequency.

As the third level chopping action, switch S5 alternatively switches between the outputs of switch S1 and switch S3, switch S6 alternatively switches between the outputs of switch S2 and switch S4, switch S7 alternatively switches between the outputs of switch S1 and switch S3, and switch S8 alternatively switches between the outputs of switch S2 and switch S4.

Chopping switch S5 and switch S7 select different MOSFETs from each other, and chopping switch S6 and switch S8 select different MOSFETs from each other. In other words, when S5 switches to S1, S7 switches to S3, and when S5 switches to S3, S7 switches to S1. When S6 switches to S2, S8 switches to S4, and when S8 switches to S4, S8 switches to S2.

Alternatively, chopping switches S1-S8 can be located between the current mirror transistors M1 to M3.2 and cascode transistors M4 to M7. For example, each of chopping switches S1-S4 can be connected to the respective drains of the transistors M1 to M3.2, and each of chopping switches S5-S8 can be connected to the respective sources of the transistors M4 to M7.

Figure 6:
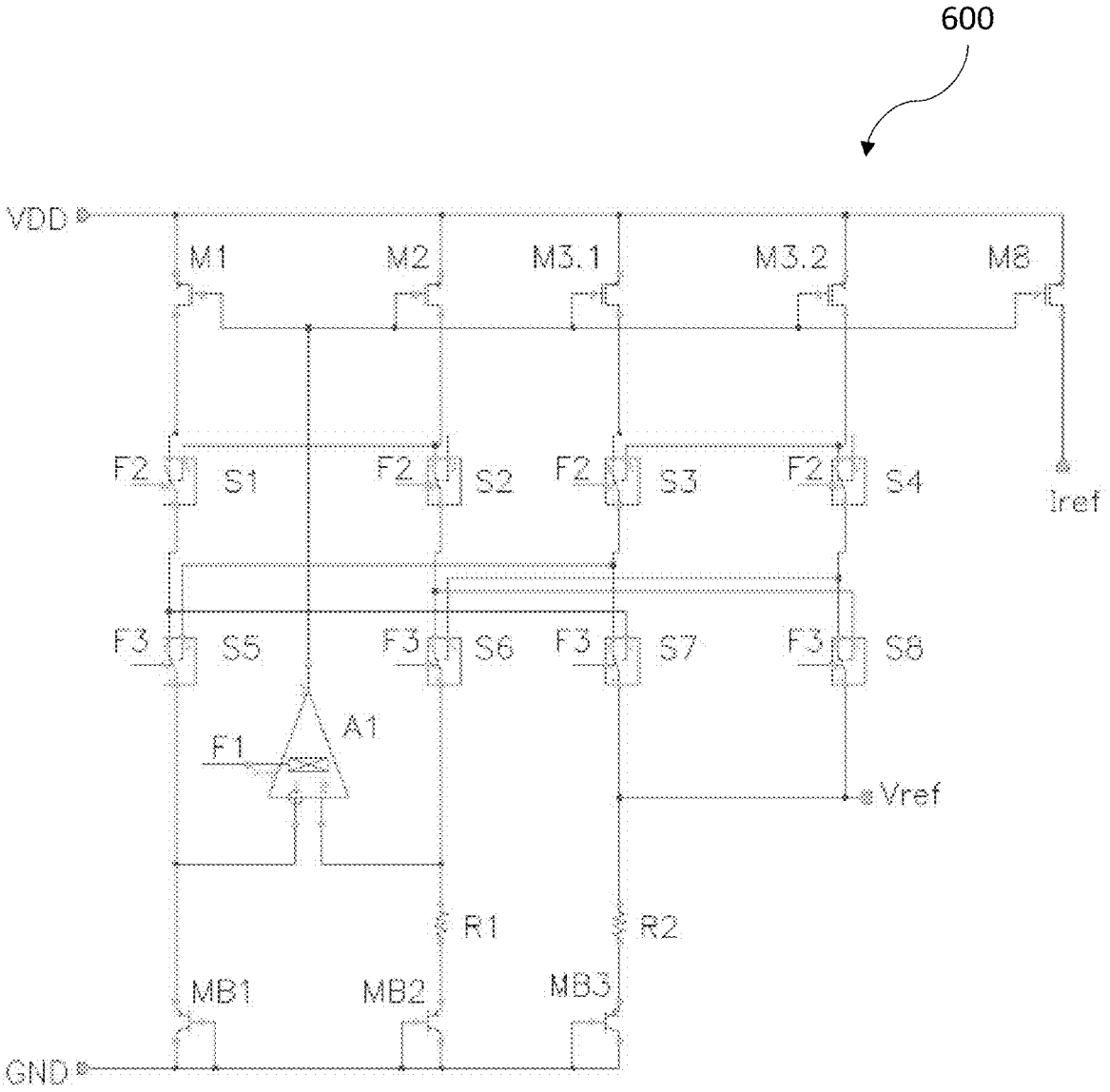
FIG. 6 illustrates another example of a current-mode bandgap reference circuit according to one embodiment of the present disclosure.

FIG. 6 illustrates another example of current-mode bandgap reference circuit 600 according to one embodiment of the present disclosure. The bandgap reference circuit 600 illustrated in FIG. 6 is similar to the current-mode bandgap reference circuit 400 in FIG. 4 other than that one additional current mirror transistor is provided to the current mirror circuit in the circuit 600. Thus, the repeated descriptions thereof are omitted.

In the embodiment, one or more current mirror transistors can be added with its gate connected to the gates of the other current mirror transistors in order to generate an output reference PTAT current Iref.

As illustrated in FIG. 6, MOSFET M8 is added with its gate connected to the gates of the other current mirror transistors M1 to M3.2. Additional current mirror transistor M8 produces a reference PTAT current Iref at its drain.

One of the benefits of the current-mode bandgap reference circuit 600 is that it can provide two output signals, a stable reference voltage and a PTAT current. The PTAT current is often used to bias other electronic blocks in the circuit. Also, one of the benefits of the PTAT current is that it tracks and cancels the decrease of the transconductance of MOS transistors over temperature and allows to design MOS active circuits and amplifiers with temperature-stable transconductance and bandwidth.

Figure 7:
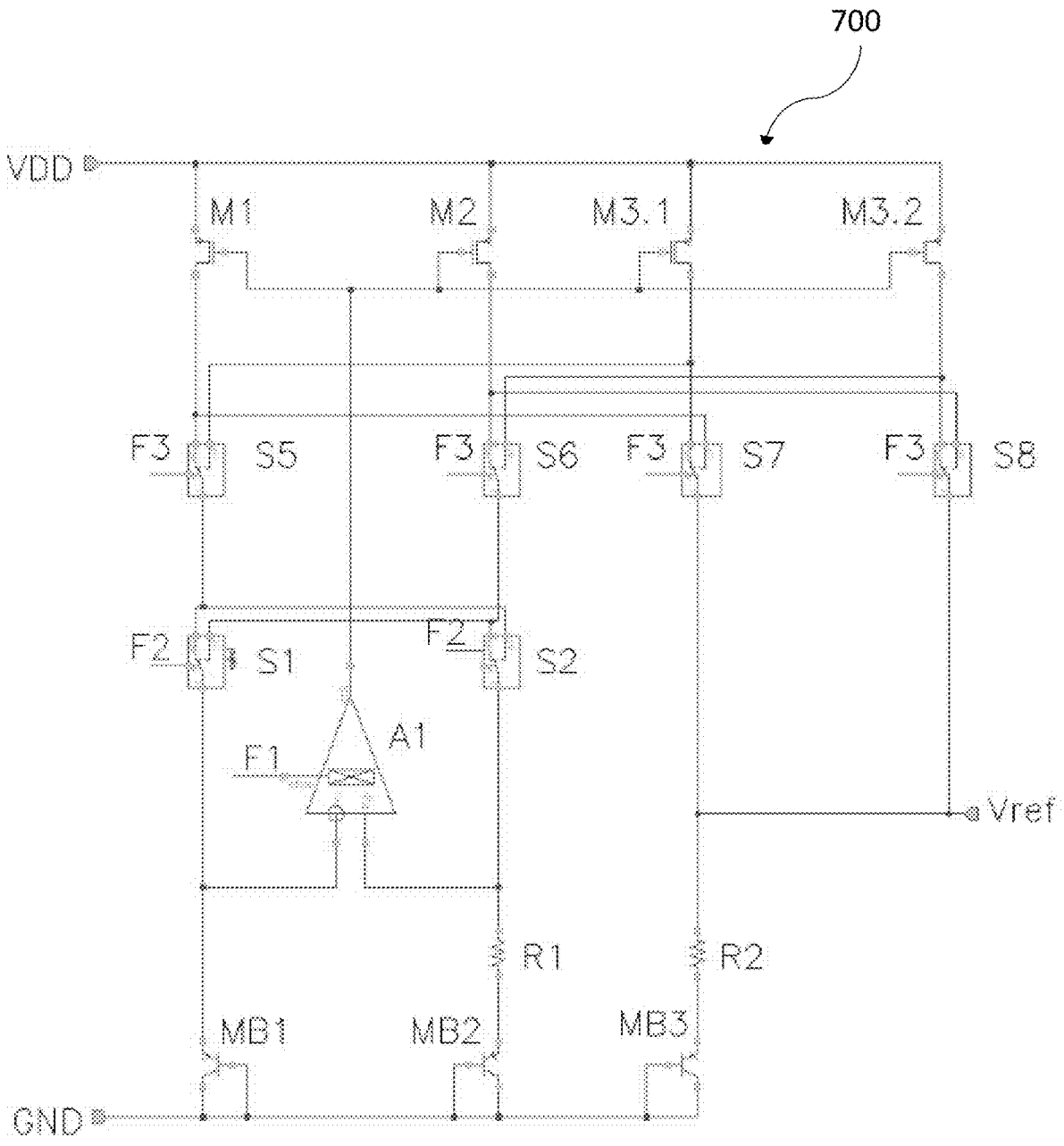
FIG. 7 illustrates another example of current-mode bandgap reference circuit according to one embodiment of the present disclosure.

FIG. 7 illustrates another example of current-mode bandgap reference circuit 700 according to one embodiment of the present disclosure. The bandgap reference circuit 700 illustrated in FIG. 7 is similar to the current-mode bandgap reference circuit 400 in FIG. 4 other than that chopping switches are arranged differently in the circuit 700. The repeated descriptions thereof are omitted.

Bandgap reference circuit 700 can include six chopping switches. Switch S5 is configured to alternatively switch between M1 and M3.1, switch S6 configured to alternatively switch between M2 and M3.2, switch S7 configured to alternatively switch between M1 and M3.1, and switch S8 configured to alternatively switch between M2 and M3.2. Switch S5 and switch S6 select different MOSFETs from each other, and switch S7 and switch S8 select different MOSFETs from each other. When S5 switches to M1 S7 switches to M2, and when S5 switches to M2 S7 switches to M1. When S6 switches to M3.1 S8 switches to M3.2, and when S6 switches to M3.2 S8 switches to M3.1. All of switches S5 to S8 are operated at a frequency F3.

Bandgap reference circuit 700 can further include switch S1 configured to electrically connect either switch S5 or switch S6 to bipolar junction transistor MB1, and switch S2 configured to electrically connect either switch S5 or switch S6 to bipolar junction transistor MB2. Switch S1 and switch S2 select different MOSFETs from each other. In other words, when S1 switches to S5 S2 switches to S6, and when S1 switches to S6 S2 switches to S5.

Chopping switches S1 and S2 are operated at a frequency F2. In this embodiment, two chopping switches S3, S4 can be omitted, compared to the switch configuration illustrated in FIG. 4.

In the above embodiments, transistors M1 to M3.2 and M4 to M8 are implemented by MOSFETs. However, transistors M1 to M3.2 and M4 to M8 can be implemented by other types of transistors, such as junction gate field-effect transistors (JFETs) or bipolar junction transistors (BJTs).

Figure 8A:
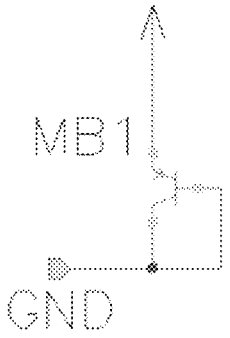
FIGS. 8A to 8D illustrate different diode configurations for bipolar junction transistors and FIG. 8E illustrate a diode to replace any of the bipolar transistors according to embodiments of the present disclosure.
Figure 8B:
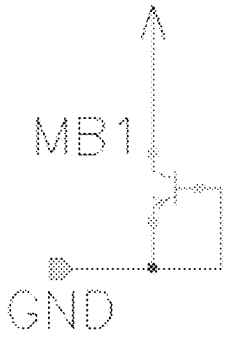
Figure 8C:
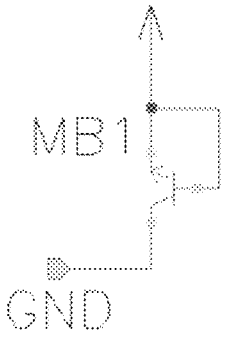
Figure 8D:
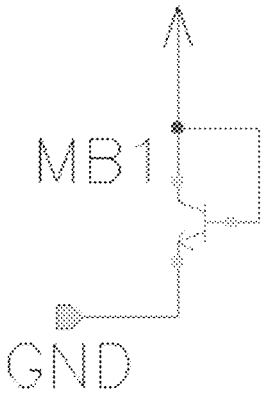
Figure 8E:
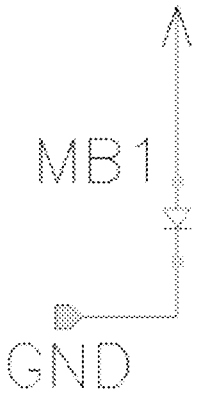

In the above embodiments, each of transistors MB1, MB2 and MB3 is provided in a diode configuration by coupling its base and collector as illustrated in FIG. 8A. Transistors MB1, MB2 and MB3 can be configured in multiple ways to form a diode: its emitter and base are coupled and are grounded as illustrated in FIG. 8B; its emitter and base are coupled and its collector is grounded as illustrated in FIG. 8C; and its collector and base are coupled and its emitter is grounded as illustrated in FIG. 8D. Alternatively, diodes can be used instead of transistors MB1, MB2 and MB3 as illustrated in FIG. 8E.

Figure 9:
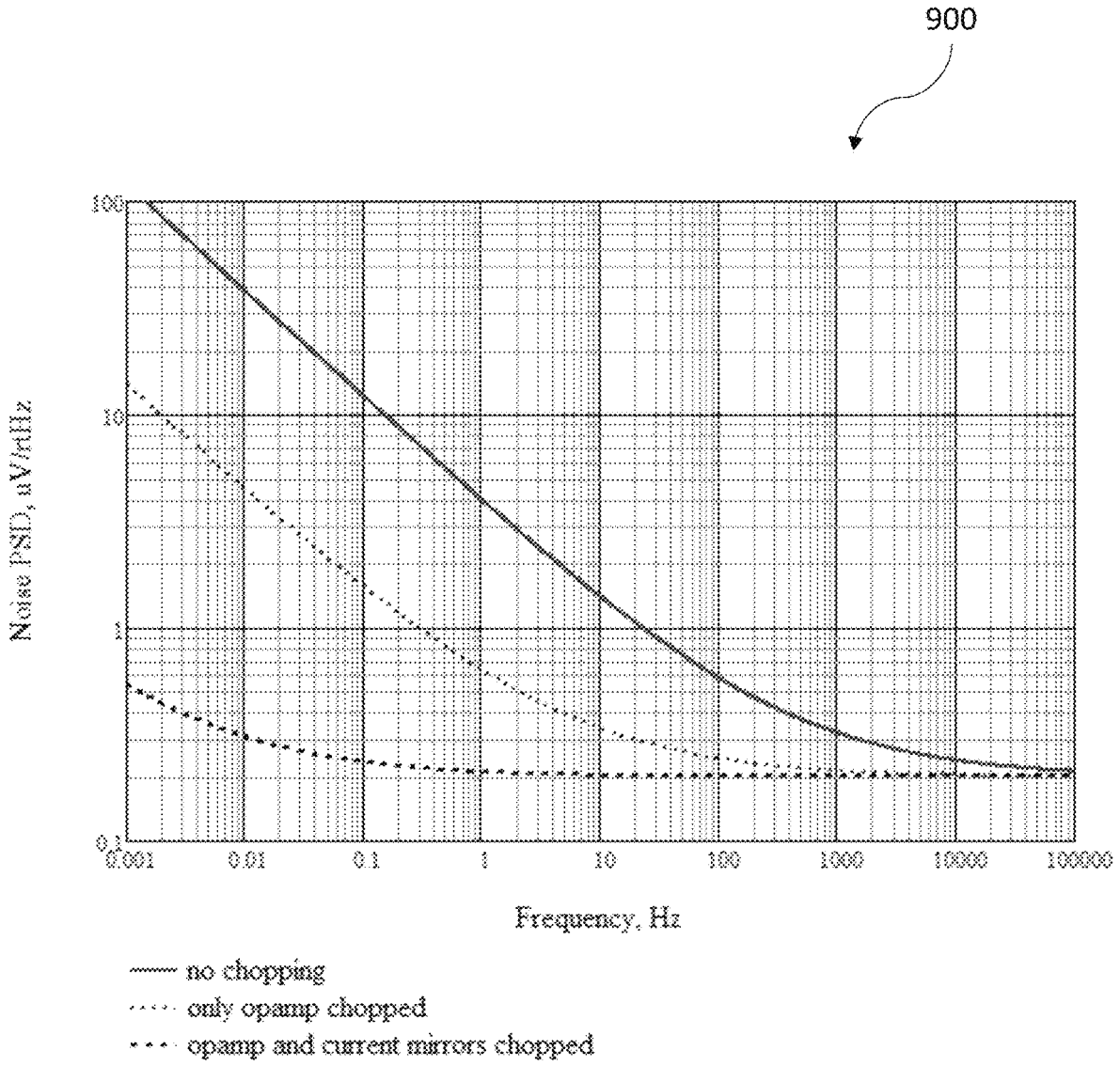
FIG. 9 illustrates an example of the simulated noise PSD plots for verifying performance of the chopping circuits according to embodiments of the present disclosure.

FIG. 9 illustrates an example of the simulated noise PSD plots for verifying performance of the chopping circuits according to embodiments of the present disclosure.

The noise performance of the implementation of bandgap reference circuit 500 illustrated in FIG. 5 was simulated and results were compared with the noise performance of a current-mode bandgap reference circuit 200 with no chopping actions and the current-mode bandgap circuit 200 of FIG. 2 with chopping applied only to operational amplifier A1.

As shown in the simulated results, chopping the operational amp reduces the noise PSD at 1 mHz by about an order of magnitude from 120 uV/rtHz to 13.7 uV/rtHz. The additional chopping of the current mirrors according to bandgap reference circuit 500 illustrated in FIG. 5 further reduced the noise PSD at 1 mHz by approximately additional factor of 5 from 13.7 uV/rtHz to 3.14 uV/rtHz.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A bandgap reference circuit, comprising:

a first current mirror including a pair of a first metal-oxide-semiconductor field-effect transistor (MOSFET) and a second MOSFET;

a second current mirror including a pair of a third MOSFET and a fourth MOSFET;

the third MOSFET electrically connected to the first current mirror and configured to provide a reference voltage at a drain of the third MOSFET;

a first bipolar junction transistor electrically connected to the first current mirror;

a second bipolar junction transistor electrically connected to the first current mirror via a first resistor;

a third bipolar junction transistor electrically connected to the third MOSFET via a second resistor; and a plurality of chopping switches configured to perform chopping actions on outputs of the first current mirror and the second current mirror.

2. The bandgap reference circuit of claim 1, further comprising:

an operational amplifier with first and second inputs and an output, wherein each of the first and second inputs is connected to emitters of the first bipolar junction transistor and the second bipolar junction transistor, respectively, and the output is connected to gate of the first MOSFET, the second MOSFET, and the third MOSFET, respectively, wherein the first and second inputs to the operational amplifier are chopped with a first frequency.

3. The bandgap reference circuit of claim 1, wherein collectors of the first, second and third bipolar junction transistors are electrically coupled to be grounded.

4. The bandgap reference circuit of claim 1, wherein the plurality of chopping switch includes a first switch and a second switch, the first switch is configured to alternately electrically connect the first MOSFET and the second MOSFET to the first bipolar junction transistor, and the second switch is configured to alternately electrically connect the first MOSFET and the second MOSFET to the first resistor, wherein when the first switch connects the first MOSFET the second switch connects the second MOSFET, and when the first switch connects the second MOSFET the second switch connects the first MOSFET, wherein the first switch and the second switch are operated at a second frequency.

5. The bandgap reference circuit according to claim 4, wherein the fourth MOSFET electrically connected to the first current mirror and to the second resistor.

6. The bandgap reference circuit of claim 5, wherein the plurality of chopping switch includes a third switch and a fourth switch, the third switch is configured to alternatively electrically connect the third MOSFET and the fourth MOSFET to the second resistor, and the fourth switch is configured to alternatively electrically connect the third MOSFET or the fourth MOSFET to the second resistor, wherein when the third switch connects the third MOSFET the fourth switch connects the fourth MOSFET, and when the third switch connects the fourth MOSFET the fourth switch connects the third MOSFET, wherein the third switch and the fourth switch are operated at the second frequency.

7. The bandgap reference circuit of claim 6, wherein the plurality of chopping switch includes a fifth switch, a sixth switch, a seventh switch and an eighth switch, the fifth switch is configured to alternatively connect the first switch and the third switch to the first bipolar junction transistor;

the sixth switch is configured to alternatively connect the second switch and the fourth switch to the first resistor;

the seventh switch is configured to alternatively connect the first switch and the third switch to the second resistor; and the eighth switch is configured to alternatively connect the second switch and the fourth switch to the second resistor, wherein when the fifth switch connects the first switch the seventh switch connects the third switch and when the fifth switch connects the third switch the seventh switch connects the first switch, wherein when the sixth switch connects the second switch the eight switch connects the fourth switch, and when the sixth switch connects the fourth switch the eight switch connects the second switch, wherein the fifth, sixth, seventh and eight switches are configured to be operated at a third frequency.

8. The bandgap reference circuit of claim 7, wherein a value of the second frequency is equal to a value of the third frequency multiplied by a factor of a power of 2.

9. The bandgap reference circuit according to claim 6, further comprising:

a third current mirror comprising a fifth MOSFET and a sixth MOSFET, the third current mirror electrically connected to the first switch and the second switch, and a fourth current mirror comprising a seventh MOSFET and an eighth MOSFET, the fourth current mirror electrically connected to the third switch and the fourth switch.

10. The bandgap reference circuit according to claim 5, further comprising:

a ninth MOSFET of which gate is electrically connected to gates of the first MOSFET, the second MOSFET, the third MOSFET and the fourth MOSFET, the ninth MOSFET configured to generate an output reference proportional to absolute temperature (PTAT) current.

11. The bandgap reference circuit according to claim 1, wherein the fourth MOSFET is electrically connected to the first current mirror and to the second resistor, the plurality of chopping switch includes a first switch, a second switch, a third switch and a fourth switch, the first switch is configured to alternatively switch between the first MOSFET and the third MOSFET, the second switch is configured to alternatively switch between the second MOSFET and the fourth MOSFET, the third switch is configured to alternatively switch between the first MOSFET and the third MOSFET, and the fourth switch is configured to alternatively switch between the second MOSFET and the fourth MOSFET, wherein when the first switch connects the first MOSFET the third switch connects the third MOSFET, and when the first switch connects the third MOSFET the third switch connects the first MOSFET, wherein when the second switch connects the second MOSFET the fourth switch connects the fourth MOSFET, and when the second switch connects the fourth MOSFET the fourth switch connects the second MOSFET, wherein the first, second, third and fourth switches are operated at a fourth frequency.

12. The bandgap reference circuit according to claim 11, wherein the plurality of chopping switch includes a fifth switch and a sixth switch; and the fifth switch is configured to alternatively electrically connect the first switch and the second switch to the first bipolar junction transistor, the sixth switch is configured to alternatively electrically connect the first switch and the second switch to the first resistor, wherein when the fifth switch connects the first switch the sixth switch connects the second switch, and when the fifth switch connects the first switch the sixth switch connects the second switch, wherein the fifth and sixth switches are operated at a fifth frequency.

13. A bandgap reference circuit, comprising:

a first current mirror including a pair of a first MOSFET and a second MOSFET;

a second current mirror including a third MOSFET and a fourth MOSFET, the third MOSFET electrically connected to the first current mirror device and configured to provide a reference voltage, and the fourth MOSFET electrically connected to the first current mirror and to a first resistor;

a first bipolar junction transistor electrically connected to the first current mirror;

a second bipolar junction transistor electrically connected to the first current mirror via the first resistor;

a third bipolar junction transistor electrically connected to the third MOSFET via a second resistor; and an operational amplifier with first and second inputs and an output, wherein each of the first and second inputs is connected to emitters of the first bipolar junction transistor and the second bipolar junction transistor, respectively, and the output is connected to gates of the first MOSFET, the second MOSFET, and the third MOSFET, respectively, wherein the first and second inputs to the operational amplifier are chopped with a first frequency.

14. The bandgap reference circuit according to claim 13, further comprising:

a first switch configured to alternatively electrically connect the first MOSFET and the second MOSFET to the first bipolar junction transistor; and a second switch configured to alternatively electrically connect the first MOSFET and the second MOSFET to the first resistor, wherein when the first switch connects the first MOSFET the second switch connects the second MOSFET and when the first switch connects the second MOSFET the second switch connects the first MOSFET, wherein the first switch and the second switch are operated at a first frequency.

15. The bandgap reference circuit of claim 14, further comprising:

a third switch configured to alternatively electrically connect the third MOSFET or the fourth MOSFET to the second resistor; and a fourth switch configured to electrically connect the third MOSFET or the fourth MOSFET to the second resistor, wherein the third switch connects the third MOSFET the fourth switch connects the fourth MOSFET, and the third switch connects the fourth MOSFET the fourth switch connects the third MOSFET.

16. The bandgap reference circuit of claim 15, further comprising:

a fifth switch configured to alternatively connect the first switch or the third switch to the first bipolar junction transistor;

a sixth switch configured to alternatively connect the second switch or the fourth switch to the first resistor;

a seventh switch configured to alternatively connect first switch or the third switch to the second resistor; and an eighth switch configured to alternatively connect the second switch or the fourth switch to the second resistor, wherein when the fifth switch connects the first switch the seventh switch connects the third switch, and the fifth switch connect the third switch the seventh switch connects the first switch, wherein when the sixth switch connects the second switch the eight switch connects the fourth switch, and the sixth switch connects the fourth switch the seventh switch connects the second switch, wherein the fifth, sixth, seventh and eight switches are configured to be operated at a second frequency.

17. The bandgap reference circuit of claim 16, wherein a value of the second frequency is equal to a value of the third frequency multiplied by a factor of a power of 2.

18. The bandgap reference circuit according to claim 14, further comprising:

a fifth MOSFET of which gate is electrically connected to gates of the first, second, third and fourth MOSFETs, the fifth MOSFET configured to generate an output reference proportional to absolute temperature (PTAT) current.

19. The bandgap reference circuit of claim 13, further comprising a first switch configured to alternatively switch between the first MOSFET and the third MOSFET;

a second switch configured to alternatively switch between the second MOSFET and the fourth MOSFET;

a third switch configured to alternatively switch between the first MOSFET and the third MOSFET;

a fourth switch configured to alternatively switch between the second MOSFET and the fourth MOSFET, a fifth switch configured to alternatively electrically connect the first switch and the second switch to the first bipolar junction transistor; and a sixth switch configured to alternatively electrically connect the first switch and the second switch to the first resistor, wherein when the first switch connects the first MOSFET the third switch connects the third MOSFET, and when the first switch connects the third MOSFET the third switch connects the first MOSFET, wherein when the second switch connects the second MOSFET the fourth switch connects the fourth MOSFET, and when the second switch connects the fourth MOSFET the fourth switch connects the second MOSFET, wherein when the fifth switch connects the first switch the sixth switch connects the second switch, and when the fifth switch connects the first switch the sixth switch connects the second switch, wherein the first, second, third and fourth switches are operated at a fourth frequency, wherein the fifth and sixth switches are operated at a fifth frequency.

20. A bandgap reference circuit, comprising:

a first current mirror device including a pair of a first MOSFET and a second MOSFET;

a second current mirror including a pair of a third MOSFET and a fourth MOSFET, the third MOSFET electrically connected to the first current mirror device and configured to provide a reference voltage, and the fourth MOSFET electrically connected to the first current mirror and to a second resistor;

a first bipolar junction transistor electrically connected to the first current mirror;

a second bipolar junction transistor electrically connected to the first current mirror via a first resistor;

a third bipolar junction transistor electrically connected to the third MOSFET via the second resistor;

a first switch configured to alternatively switch between the first MOSFET and the third MOSFET;

a second switch configured to alternatively switch between the second MOSFET and the fourth MOSFET;

a third switch configured to alternatively switch between the first MOSFET and the fourth MOSFET, a fifth switch configured to alternatively electrically connect the first switch or the second switch to the first bipolar junction transistor; and a sixth switch configured to alternatively electrically connect the first switch or the second switch to the first resistor, wherein when the first switch connects the first MOSFET the third switch connects the third MOSFET, and when the first switch connects the third MOSFET the third switch connects the first MOSFET, wherein when the second switch connects the second MOSFET the fourth switch connects the fourth MOSFET, and when the second switch connects the fourth MOSFET the fourth switch connects the second MOSFET, wherein when the fifth switch connects the first switch the sixth switch connects the second switch, and when the fifth switch connects the second switch the sixth switch connects the first MOSFET.

* * * * *